United States Patent [19]

Perri

[11] Patent Number: 4,836,433

[45] Date of Patent: Jun. 6, 1989

[54] DEVICE FOR INTRODUCING STIRRING GAS INTO MOLTEN METAL IN METERED AMOUNT

[75] Inventor: Joseph A. Perri, Coraopolis, Pa.

[73] Assignee: Insul Company, Inc., East Palestine, Ohio

[21] Appl. No.: 193,566

[22] Filed: May 13, 1988

[51] Int. Cl.[4] ..... C21C 5/48

[52] U.S. Cl. ..... 266/266; 266/270

[58] Field of Search ..... 266/218, 220, 225, 265, 266/266, 270

[56] References Cited

U.S. PATENT DOCUMENTS

| | | | |
|---|---|---|---|
| 4,396,179 | 8/1983 | LaBate | 266/220 |
| 4,483,520 | 11/1984 | LaBate | 266/220 |
| 4,538,795 | 9/1985 | LaBate | 266/220 |
| 4,632,367 | 12/1986 | LaBate | 266/220 |
| 4,687,184 | 8/1987 | LaBate et al. | 266/270 |
| 4,725,047 | 2/1988 | LaBate | 266/270 |
| 4,758,269 | 7/1988 | Tommaney | 266/265 |

FOREIGN PATENT DOCUMENTS

| | | | |
|---|---|---|---|
| 70197 | 1/1983 | European Pat. Off. | 266/266 |

*Primary Examiner*—Robert McDowell

*Attorney, Agent, or Firm*—Harpman & Harpman

[57] ABSTRACT

A device for introducing stirring gas into a mass of molten metal in a container by way of an opening in the container and a pocket block having a plurality of metered passageways extending therethrough, the pocket block forming a portion of a refractory lining in said container, the plurality of passageways being defined by a plurality of metal tubes arranged in a spiral configuration in circumferentially spaced relation to one another in fixed position in the pocket block which is formed of a suitable refractory, preferably vitrified. The plurality of metal tubes communicate with the single tube which extends through the bottom of the container and communicates with a supply of gas, such as argon.

6 Claims, 2 Drawing Sheets

DEVICE FOR INTRODUCING STIRRING GAS INTO MOLTEN METAL IN METERED AMOUNT

BACKGROUND OF THE INVENTION

2. Technical Field:

This invention relates to devices for insufflating gas into a mass of molten metal so as to produce a desirable stirring action.

2. Description of the Prior Art:

Prior devices of the type may be seen in U.S. Pat. Nos. 4,396,179 of Aug. 2, 1983 to Micheal D. LaBate, 4,483,520 of Nov. 20, 1984 to Micheal D. LaBate, 4,538,795 of Sept. 3, 1985 to Micheal D. LaBate, 4,632,367 of Dec. 30, 1986 to Micheal D. LaBate, 4,687,184 of Aug. 18, 1987 to Micheal D. LaBate and Joseph A. Perri, and 4,725,047 of Feb. 16, 1988 to Micheal D. LaBate.

In all of these prior art devices, the gas must flow upwardly through an annular cone-shaped passageway formed about a refractory plug positioned in a cavity in a pocket block or the like.

The present invention comprises an improvement with respect to the prior art devices in that a block shaped section of refractory material, preferably ceramic and vitrified, adapted to form a part of the refractory brick lining in a container of molten metal such as a ladle carries a gas supply tube which communicates with a plurality of smaller metal tubes embedded in the block of ceramic material and arranged in a circular pattern in which the smaller metal tubes are spirally positioned in a cone-shaped configuration communicating with the upper surface of the ceramic block so that gas such as argon delivered therethrough into molten metal will be imparted a swirling, stirring motion by reason of the directional inclination of each of the several smaller metal tubes, portions of which are flattened to form relatively narrow rectangular openings sized to control the volume of gas delivered therethrough.

SUMMARY OF THE INVENTION

A device for introducing gas into molten metal in a container, such as a ladle or the like, comprises a block of refractory material incorporated in the bricked or rammed lining of the container, the block having a gas supply pipe extending out of the lower portion thereof and communicating in the block with a plurality of smaller metal tubes arranged in a circular pattern and extending upwardy from the pipe in a spiral configuration defining a cone-shaped plurality of passageways formed by the smaller tubes which are flattened to form elongated ovals and/or narrow rectangular slots capable of delivering a known amount of gas therethrough and a known pressure whereby the gas for agitating, stirring, rolling and/or effecting the desired chemistry of the molten metal can be introduced into the molten metal in a plurality of novel streams substantially increasing the agitating, stirring and rolling action obtained.

DESCRIPTION OF THE PREFERRED EMBODIMENT

Figure 1:
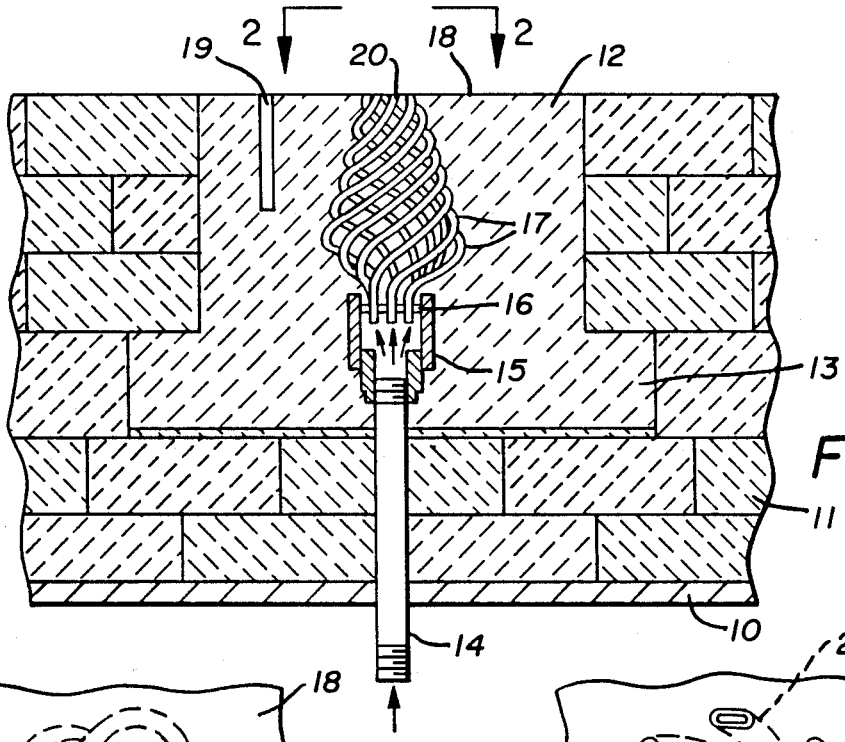
FIG. 1 is a vertical section through a portion of a container of molten metal, the lining therein and a refractory block incorporating the gas introducing device.
Figure 2:
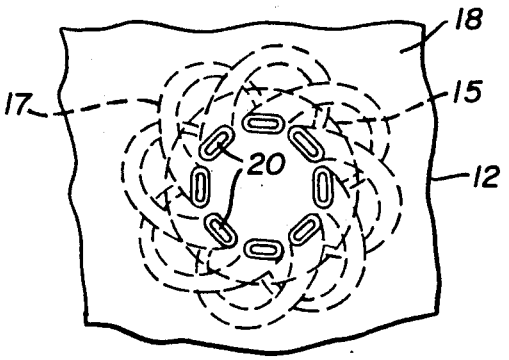
FIG. 2 is a top plan view of a portion of the device taken on line 2—2 of FIG. 1.

The preferred form of the invention disclosed herein appears in FIGS. 1 and 2 of the drawings and by referring thereto it will be seen that a portion of the bottom of a molten metal container such as a ladle 10 has been illustrated with a conventional refractory brick lining 11 therein. A block 12 of refractory material, preferably ceramic and vitrified, is illustrated built into the refractory brick lining 11, the block 12 having an enlarged lower section 13, the peripheral edges of which extend as a flange from the main body of the block 12 and are therefore capable of being overlaid with the conventional refractory brick of the lining of the ladle. A gas supply pipe 14 extends vertically through an opening in the bottom of the ladle 10 and through some of the refractory brick lining the ladle and into the block 12 where it communicates with a composite fitting 15, the upper portion of which comprises an apertured disc 16. A plurality of relatively small metal tubes 17 are engaged in the apertures in the apertured disc 16 and extend upwardly therefrom to the upper surface 18 of the block 12. Those skilled in the art will recognize the block 12 as being similar in location and function to the more or less conventional pocket block known in the industry through which gas is introduced into molten metal.

In FIGS. 1 and 2 of the drawings, the plurality of relatively small metal tubes 17 are arranged in a circular pattern which in turn is formed in a spiral configuration so that the upper ends of the plurality of smaller metal tubes 17 engage the upper surface 18 of the block 12 at angles whereby gas moving upwardly therethrough is injected into molten metal in the ladle 10 tangentially of the surface 18 of the block 12 so as to create a swirling, stirring motion in the molten metal.

In FIGS. 1 and 2 of the drawings, the upper ends of the smaller metal tubes 17 are arranged in a circle in circumferentially spaced relation to one another and the diameter of the circle is approximately the same diameter as the diameter of the composite fitting 15 with which the lower ends of the plurality of smaller metal tubes 17 communicate. The configuration of the circular spiral pattern thus formed discharges gas into molten metal so as to create a relatively small swirling, spinning column of molten metal as compared for example with the pattern formed in molten metal by the second form ofthe invention as illustrated in FIGS. 3 and 4 of the drawings and hereinafter described.

Figure 4:
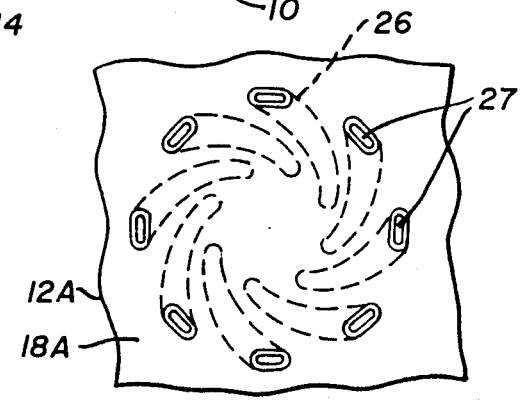
FIG. 4 is a top plan view of a portion of the device of FIG. 3 taken on line 4—4 thereof.
Figure 3:
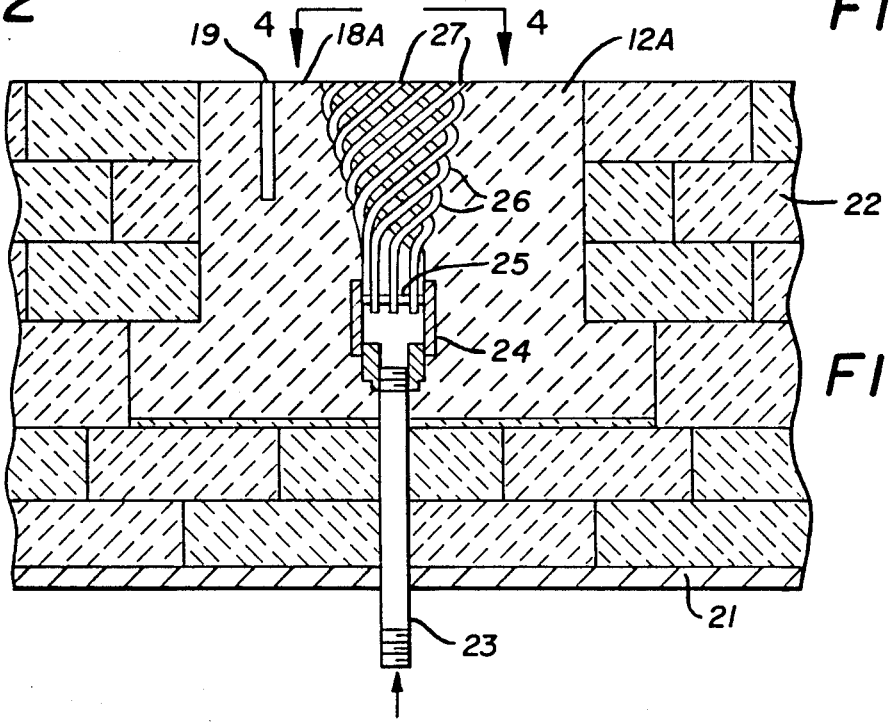
FIG. 3 is a vertical section similar to FIG. 1 illustrating a modified form of gas introducing device.

In FIGS. 1 and 2 of the drawings, the circular arrangement of the spirally formed smaller metal tube 17 is generally cone-shaped with the apex of the cone toward the upper end of the device in the block 12, while in FIGS. 3 and 4 of the drawings the cone configuration of the plurality of smaller metal tubes is reversed and the largest diameter of the circular arrangement of the smaller tubes communicates with the surface of the block in that modification of the invention.

In FIGS. 1 and 2 of the drawings, a refractory erosion visual indicator 19 is shown embedded in the block 12 and the same is disclosed in allowed U.S. patent application Ser. No. 07/070,057 filed July 6, 1987, now U.S. Pat. No. 4,744,544 the invention being assigned to Insul Company, Inc., the assignee of the present invention.

By referring again to FIGS. 1 and 2 of the drawings, it will be seen that each of the plurality of smaller metal tubes 17 has a portion of the same formed in a flattened oval shape of a desirable configuration so that the device of the invention so formed can match any desired discharge of gas into the molten metal, for example gas supplied at 300 lbs. per square inch can be desirably discharged at the rate of 200 feet per minute by preshaping the flattened oval shapes of the smaller tubes 17 to a predetermined shape, for example wherein the diameter of the small metal tube is a quarter of an inch o.d. is flattened to an increased width of 5/16th of an inch to form a flattened discharge orifice of 0.026/100ths of an inch by 0.26 inch in width.

By referring now to FIGS. 3 and 4 of the drawings, a modification of the form of the invention heretofore described may be seen by referring to FIG. 3 in particular, it will be seen that a bottom section of a ladle 21 is shown with a portion of the usual refractory brick lining 22 therein and a block 12A positioned in the lining 22. A gas pipe 23 extends through an opening in the bottom 21 of the ladle and through the refractory brick lining and into the block 12A which is formed of refractory, preferably ceramic and vitrified, and communicates with a fitting 24 which includes an apertured disc 25. A plurality of smaller metal tubes 26 communicate with the fitting 24 by way of the apertured disc 25 and they are arranged in a circular pattern extending into a spiral configuration which enlarges in diameter substantially greater than the diameter of the fitting 24. For example the circular pattern of the metal tubes 26 where they extend to the surface 18A of the block 12A is substantially double the diameter of the apertured disc 25 through which they communicate with the fitting 24 and the gas supply pipe 23.

FIG. 4 of the drawings illustrates the flattened oval shapes 27 of each of the smaller metal tubes 26 where they communicate with the surface 18A of the block 12A and it will be observed by those skilled in the art that the spiral arrangement of the circular pattern of the metal tubes 26 is such that the gas directed therethrough emerges tangentially to the surface 18 of the block 12A in a relatively wide annular pattern which creates a relatively wide swirling pattern in the molten metal as compared with the prior art devices.

Figure 5:
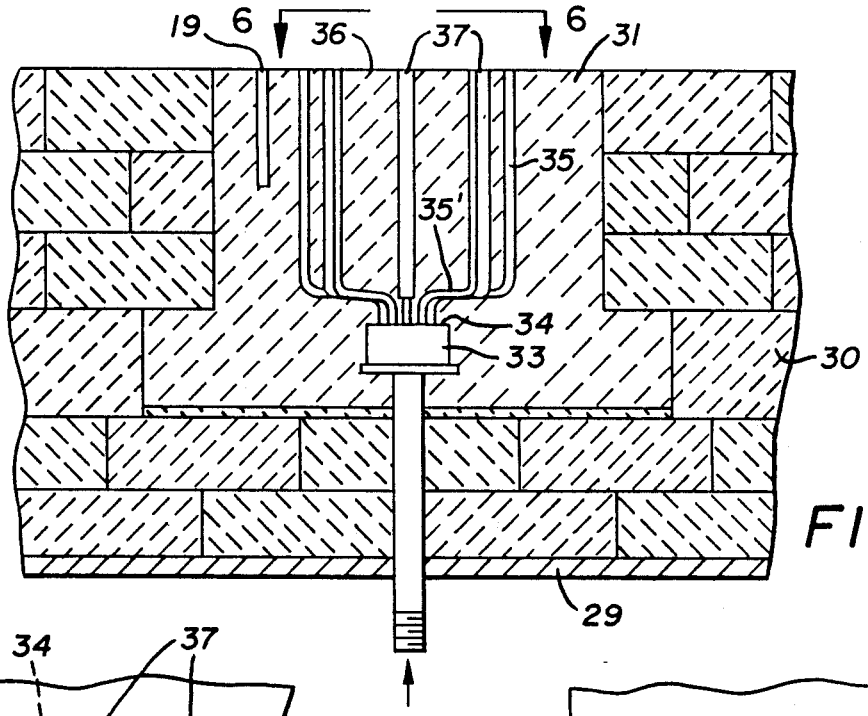
FIG. 5 is a vertical section through a portion of a molten metal container, the refractory lining therein and illustrating a a further modificatoion of the invention.
Figure 6:
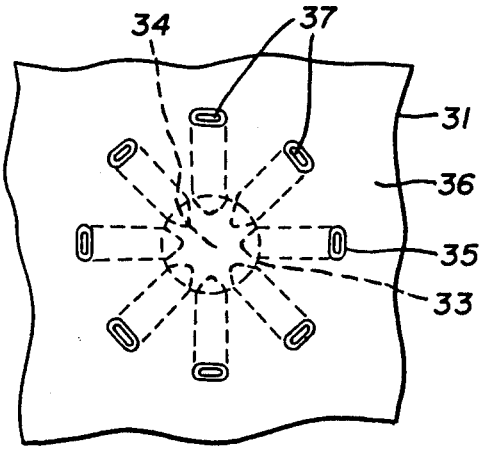
FIG. 6 is a top plan view on line 6—6 of FIG. 5.

A further modification of the invention mat be seen in FIGS. 5 and 6 of the drawings and by referring thereto, it will be seen that a bottom portion of a ladle 29 is disclosed which is provided with a refractory brick lining 30 which incidentally may be a rammed refractory lining, a block 31 is positioned therein which is preferably formed of a refractory such as vitrified ceramic. A gas supply pipe 32 extends through an opening in the bottom of the ladle 29 and upwardly through the refractory lining 30 into a fitting 33 which is provided with an apertured upper wall 34. A plurality of smaller metal tubes 35, each of which has a horizontally offset section 35 is flattened and communicates at its lower end as illustrated with the apertured wall 34 of the fitting 33 while the upper ends of the metal tubes 35 extend to the surface 36 of the block 31.

By referring to FIGS. 5 and 6 of the drawings, it will be seen that each of the metal tubes 35 are flattened throughout at least a portion of their length above the fitting 33 and that their open upper ends define elongated oval shapes 37 which are in effect rectangular slots forming a predetermined rate of flow valve for gas directed therethrough.

Those skilled in the art will observe that the gas directed upwardly out of the device of the invention as modified in FIGS. 5 and 6 of the drawings will create vertical columns of turbulent molten metal affording an unusual degree of stirring and mixing of the molten metal.

Figure 8:
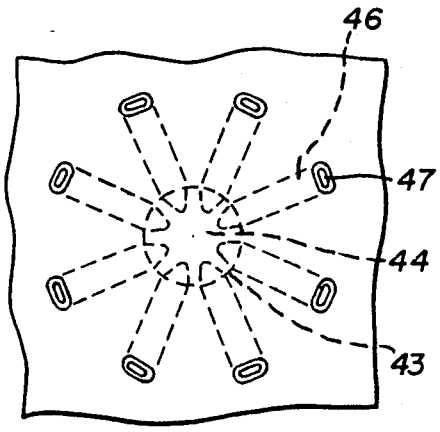
FIG. 8 is a plan view on line 8—8 of FIG. 7.
Figure 7:
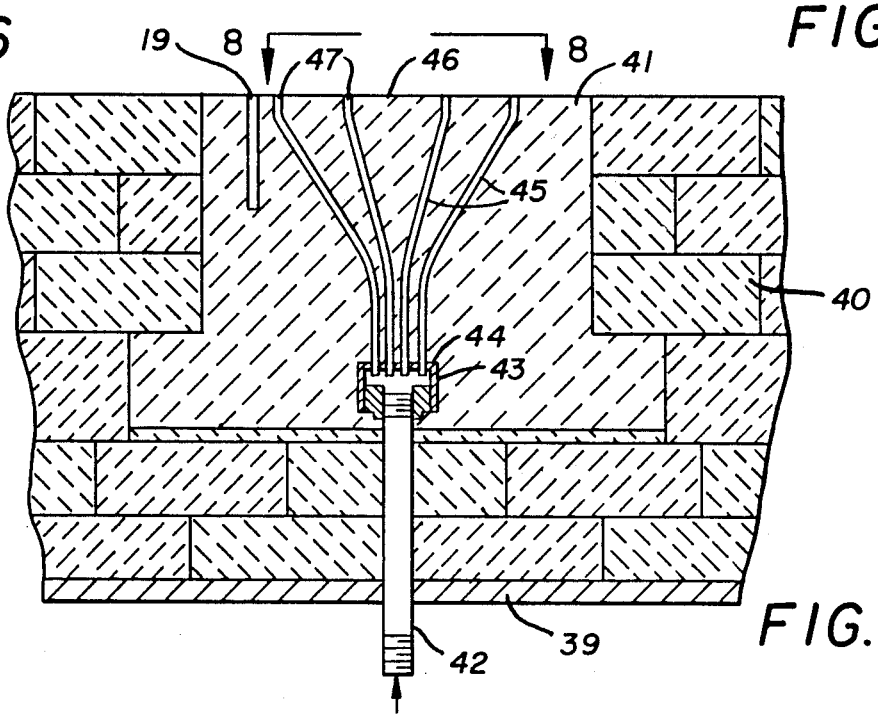
FIG. 7 is a vertical section through a molten metal container and the refractory lining thereof illustrating a further modification of the invention.

By referring to FIGS. 7 and 8 of the drawings a still further modification of the invention may be seen in which a portion of a bottom of a ladle 39 is illustrated with a lining 40 of refractory brick and a block 41A preferably ceramic and vitrified positioned therein. A gas supply pipe 42 extends downwardly through an opening end of the bottom of the ladle 39 and upwardly through the refractory brick of the lining and into the block 41A and communicates with a fitting 43 which includes an apertured wall 44. A plurality of flattened small metal pipes 45 communicate with the apertures in the apertured wall 44 so as to receive gas delivered by the pipe 42 and they extend upwardly and flare outwardly and form a circular pattern with their uppermost ends straightened wherem they communicate with the surface 46 of the block 41A.

By referring to FIG. 8 of the drawings, which is a top plan on line 8—8 of FIG. 7, it will be seen that each of the smaller metal tubes 45 is flattened throughout a portion of its length to form a flattened oval shape of a desirable configuration so that the device of the invention having the tubes so formed can match any desired discharge of gas into the molten metal. The flattened ends of the tubes 45 form elongated ovals 47.

Those skilled in the art will observe that the several forms of the device for introducing gas into molten metal in a container, such as a ladle or the like, will advantageously create the desirable swirling, stirring and columns of rising molten metal, all as desirable in the steel making art.

Although but four embodiments of the present invention have been illustrated and described, it will be apparent to those skilled in the art that various changes and modifications may be made therein without departing from the spirit of the invention and having thus described my invention what I claim is:

1. In an apparatus for introducing gas into a mass of molten metal in a container having a refractory lining, an improved device, the improved device comprising a body member of refractory material having upper and lower surfaces and an enlarged lower section forming an outwardly extending flange positioned for engagement within said refractorry lining; a plurality of passageways in said body member arranged in a spiral cone-shaped pattern, a fitting within said body member communicating with an opening in the lower surface of the body member, said plurality of passageways extending from said fitting to said upper surface of said body member, said body member forming an integral portion of said refractory lining in said container for said molten metal, said container having an opening therein in registry with said opening in the lower surface of said body member, said passageways arranged to form a plurality of streams of gas rising in said molten metal when gas is introduced through said device whereby swirling stirring motion is imparted to said molten metal.

2. The device for introducing gas into a mass of molten metal set forth in claim 1 wherein the body of refractory material is solid.

3. The device for introducing gas into a mass of molten metal set forth in claim 1 and wherein the body of refractory material is ceramic and vitrified.

4. The device for introducing gas into a mass of molten metal set forth in claim 1 and wherein said plurality of passageways are defined by a plurality of metal tubes, said fitting communicating with said plurality of metal tubes and a supply pipe communicating with said fitting and extending through said opening.

5. The device for introducing gas into a mass of molten metal set forth in claim 1 and wherein said plurality of passageways are defined by a plurality of metal tubes, each of which has a portion thereof flattened to form an orifice sized to control the volume of gas delivered therethrough.

6. The device for introducing gas into a mass of molten metal set forth in claim 1 and wherein said plurality of passageways are defined by a plurality of metal tubes, each of which is flattened to form a narrow rectangular opening sized to control the volume of gas delivered therethrough and wherein each of said plurality of metal tubes is arranged in a circumferentially spaced pattern with respect to the other and forming a spiral for forming a plurallity of streams of gas rising in said molten metal when gas is introduced through said device, said streams of gas being individually tangentially directed from said body of refractory material.

* * * * *